US005265538A

United States Patent [19]

Sampson

[11] Patent Number: 5,265,538

[45] Date of Patent: Nov. 30, 1993

[54] TRACK WARNING DETONATOR

[76] Inventor: Ronald S. Sampson, 3/23 Nelson Street, Penshurst, New South Wales 2222, Australia

[21] Appl. No.: 921,873

[22] Filed: Jul. 29, 1992

[30] Foreign Application Priority Data

Dec. 12, 1991 [AU] Australia ..... PK9971

[51] Int. Cl.[5] ..... C06C 7/00

[52] U.S. Cl. ..... 102/204; 102/205; 102/275.11; 102/275.6; 246/124; 246/120; 116/206; 116/214

[58] Field of Search ..... 102/428, 204, 205, 429, 102/424, 275.5, 275.6, 275.8, 275.9, 275.11, 275.2, 275.4; 246/124, 122 R, 120; 116/206, 214, 203, DIG. 40

[56] References Cited

U.S. PATENT DOCUMENTS

| | | | |
|---|---|---|---|
| 1,325,487 | 12/1919 | Morse | 102/204 |
| 2,507,004 | 5/1950 | Gracey, Jr. | 246/124 |
| 2,652,775 | 9/1953 | Swanson | 102/204 |
| 2,876,701 | 3/1959 | Long | 102/275.5 |
| 3,575,111 | 4/1971 | Richardson | 102/204 |
| 3,727,045 | 4/1973 | Warren et al. | 246/169 A |
| 3,739,724 | 6/1973 | Tlam | 102/275.9 |
| 3,910,190 | 10/1975 | Dare | 102/334 |
| 4,008,870 | 2/1977 | Gardner et al. | 246/120 |
| 4,092,926 | 6/1978 | Bell | 102/204 |

FOREIGN PATENT DOCUMENTS

| | | | |
|---|---|---|---|
| 852285 | 1/1940 | France | 102/429 |
| 574053 | 12/1945 | United Kingdom | 102/205 |
| 801892 | 9/1958 | United Kingdom | 102/429 |

*Primary Examiner*—Stephen M. Johnson
*Attorney, Agent, or Firm*—Townsend and Townsend Khourie and Crew

[57] ABSTRACT

A warning detonator for use on railway tracks or the like is disclosed. The detonator comprises a tube or cylinder (18) having disposed therein at spaced apart locations a length of elastomer (20) and a first explosive component (24, 25). A second explosive component (21) is located therebetween. The second explosive component (21) is also disposed within a cartridge (19) inside the cylinder (18). In use the cylinder (18) is affixed along a length of railway track in a manner whereby the wheel of a passing train progressively compresses the elastomer from its outer end so as to burst an end face (23) of the cartridge (19) and drive the second explosive component (21) into contact with the first explosive component (24, 25) to cause detonation thereof.

8 Claims, 2 Drawing Sheets

TRACK WARNING DETONATOR

This invention relates to warning devices and more particularly, although not exclusively it discloses a warning detonator for use on railway tracks or the like.

Existing warning devices for use on railway tracks typically comprise a metal or plastic cap enclosing an explosive compound which in use is fixed onto the surface of a rail and is adapted to detonate under the compression or impact of a train wheel. The resulting noise from the explosion serves to warn work crews of the approaching train. Such devices however have the serious disadvantage that they can be detonated by other sources of impact such as hammer blows or rocks thrown by children, and this can lead to serious injury.

It is therefore an object of this invention to ameliorate the aforementioned disadvantage and accordingly a warning detonator is disclosed for use on railway tracks or the like, said detonator comprising a tube or cylinder having disposed therein at spaced apart locations a length of compressible elastic means and a first explosive component, and a second explosive component being disposed therebetween, wherein in use said tube or cylinder may be affixed along a length of railway track in a manner whereby the wheel of a passing train progressively compresses said length of elastic means so as to drive said second explosive component either directly and/or by air pressure into contact with said first component and cause detonation thereof.

Preferably but not essentially the tube or cylinder may be enclosed within an outer housing which is adapted to clamp over the surface of said length of railway track.

Preferably but not essentially said first explosive component comprises quantities of potassium chlorate and smokeless powder which are located adjacent each other.

It is also preferred that said second explosive component be disposed within a cap or cartridge which is located inside said tube or cylinder. This cap being adapted to burst and release said second explosive component under a predetermined force from said elastic means as it is compressed.

Figure 1:
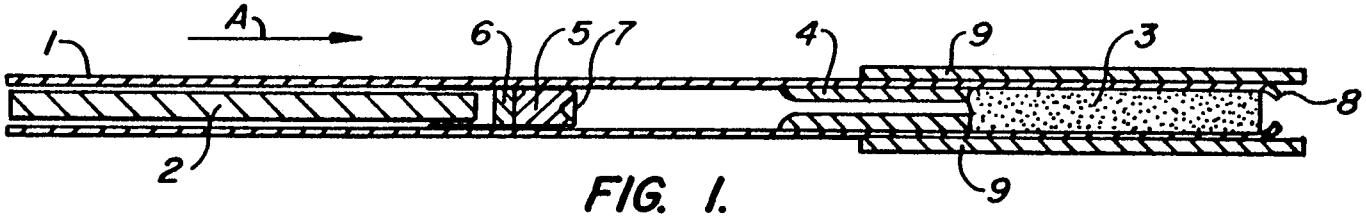
Figure 5:
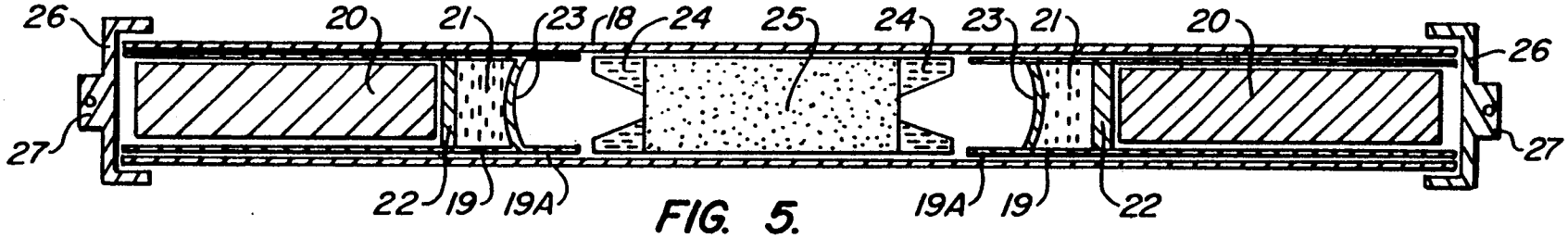
Figure 6:
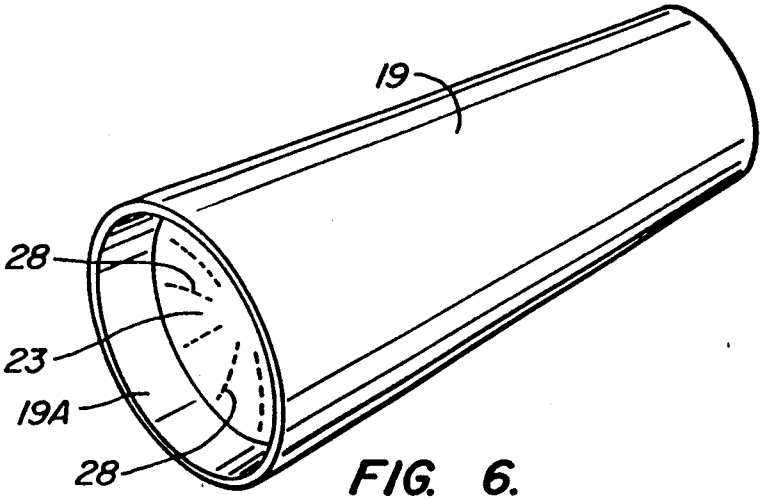
Figure 2:
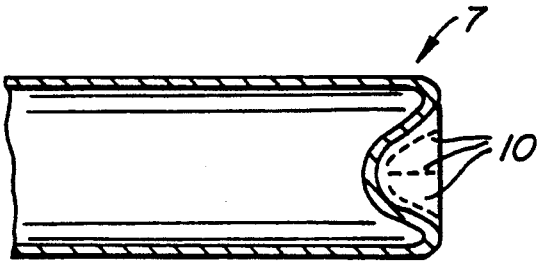
Figure 3:
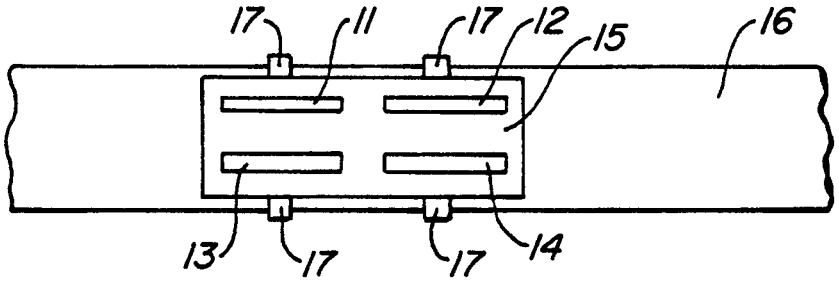
Figure 4:
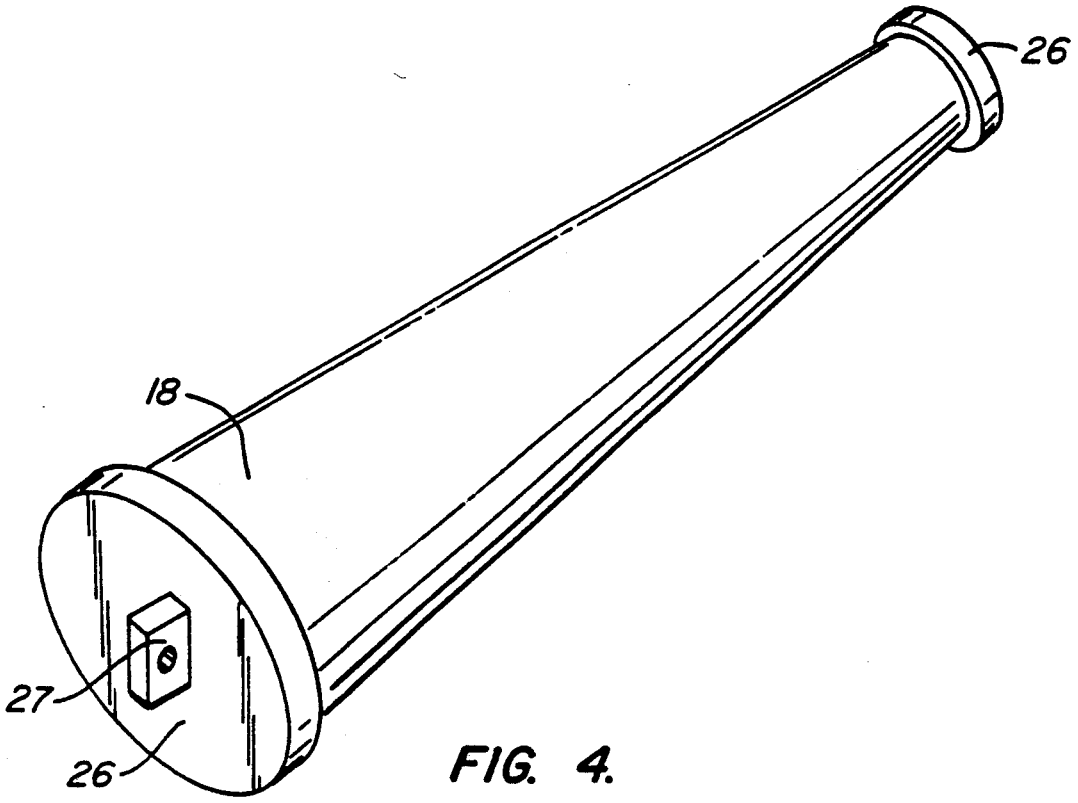

Two currently preferred embodiments of this invention will now be described with reference to the attached drawings in which:

FIG. 1 is a longitudinal cross-sectional view of a track warning detonator according to a first embodiment of this invention, FIG. 2 is a longitudinal cross-section of the preferred form of cap for enclosing the second explosive component in the detonator of FIG. 1, FIG. 3 shows the currently preferred form of clamp for attaching the detonator of FIG. 1 to a section of railway track, FIG. 4 shows a perspective view of a track warning detonator according to a second embodiment of this invention, FIG. 5 shows a longitudinal cross-section of the detonator of FIG. 4, and FIG. 6 shows a perspective view of the cartridge for enclosing the second explosive component in the detonator of FIG. 4.

Referring first to FIG. 1 the device may comprise a brass tube 1 with a length of elastomer sponge material 2 disposed within one end and a measure of explosive such as smokeless powder 3 and potassium chlorate 4 at the other. Located adjacent the inner face of the elastomer sponge is a quantity of red phosphorous 5. This phosphorous is separated from the elastomer 2 by a wadding 6 and is preferably located within a metal or plastic cap 7 which is fixed inside tube 1.

The potassium chlorate 4 is spaced from the metal or plastic cap and abuts the smokeless powder 3. The adjacent end 8 of the tube may be knurled over to prevent any spilling of the contents. A plastic sleeve 9 may also be fitted over this end portion of the tube to increase the bursting pressure and thus the detonation noise of the powder.

As shown in FIG. 2 the metal cap 7 is preferably shaped to a notched or concave configuration. This increases the safety of the device for reasons described later. Lines of weakness 10 may also be formed in the cap to facilitate its bursting and the release of the phosphorous.

In use the detonator according to this first embodiment of the invention is affixed over a length of rail so that the arc of an oncoming train wheel initially encounters and progressively crushes the left end section of the tube as shown in FIG. 1. This compresses the elastomer material 2 in the direction shown by arrow A. The resulting compressive force or air pressure exerted on the wadding 6 and phosphorous 5 builds up until it is sufficient to burst the cap 7 and drive this phosphorous down the tube and into the potassium chlorate to cause ignition and detonation of the smokeless powder 3.

Although it is not essential to the invention a plurality of detonators 11, 12, 13 and 14 constructed according to the first embodiment of this invention may be mounted in a holding unit 15 as shown in FIG. 3. This unit may incorporate a guillotine means (not shown) which operates to sever the tube to permanently separate the red phosphorous and potassium chlorate under lateral impact. The detonators are thereby rendered inoperative. Preferably the longitudinally opposed pairs of detonators 11, 12 and 13, 14 also face in opposite directions so that detonation occurs on either direction of train travel over rail 16. The holding unit may include any suitable means 17 for extending over and clamping the top of the rail.

Referring now to FIGS. 4 and 5 the device in an alternative form comprises an outer housing 18 of aluminium tube. located at each end of the housing are cylindrical plastic cartridges 19. Each cartridge has disposed within it a length of elastomer material 20 and a quantity of red phosphorous 21. This phosphorous is separated from the elastomer by a rubber plug 22 and sits against the inner side of concave end face 23 of the cartridge. A measure of potassium chlorate 24 is also disposed on the other side and spaced from each of the faces 23. This potassium chlorate 24 abuts a central charge 25 of smokeless powder. In order to maintain spacing between the potassium chlorate 24 and the end faces 23 the walls 19A of the cartridges may extend out past said faces. Caps 26 of any suitable material may be fitted over each end of the housing to protect the contents from moisture etc. Straps or wires may also be fitted through lugs 27 on these caps to secure the device over a railway track.

As shown in FIGS. 5 and 6 each cartridge is preferably cylindrical and dimensioned to be a push fit into the housing 18. The end face 23 however as mentioned earlier is slightly concave (an approximate radius being for example 8 mm). Lines of weakness 28 may also be formed in this end face to facilitate its bursting and the release of the phosphorous.

Preferably the cartridge 19 is moulded from any suitable type of shatterproof plastic so that a lateral blow while deforming the walls or collapsing the end 23 inwardly will not rupture it.

In use a detonator according to this second embodiment of the invention is similarly fixed over a length of rail so that the arc of an oncoming train encounters and progressively crushes either end section of the housing 18. This compresses the elastomer material 20 in the direction of the closest end face 23. The resulting compressive force exerted on the rubber plug 22 and phosphorous 21 builds up until it is sufficient to burst this face and drive the phosphorous out of the cartridge and into the potassium chlorate 24 to cause detonation of the power 25 at the center of the tube.

Due to the aforementioned novel construction detonators according to this invention are substantially safer than existing devices. This is because impacts to the side of the tube or cartridge encasing the elastomer will not compress it longitudinally in the manner required to burst the cap or end face of the cartridge. Further, any lateral blows along the rest of the detonator length will not ignite or detonate the powder 3 or patassium chlorate. Indeed even a lateral blow directly on the cap or concave end face will simply crush the face inwardly and seal the phosphorous inside so as to render the detonator inert and unusable.

It will thus be appreciated that this invention at least in the form of the embodiment described provides a novel and unique improvement in warning detonators for railway tracks. Clearly however the particular example disclosed is only the currently preferred form of this invention and a wide variety of modifications may be made which would be apparent to a person skilled in the art. For example the shape and configuration of the tube, the material of which it is made and the nature and composition of the chemicals used may all be changed according to application or design preference.

I claim:

1. A warning detonator for use on a railway track, said detonator comprising a cylinder having a first explosive component disposed therein at substantially the center thereof, lengths of compressible elastic means disposed at or adjacent the ends of the cylinder and a second explosive component located inside respective cartridges within the cylinder and disposed between each of said elastic means and the first component whereby in used said cylinder is fixed along a length of said railway track so that a wheel of a passing train causes detonation of said detonator by progressively compressing said elastic means at one of the ends of said cylinder thereby causing one of said cartridges between the compressed elastic means and said first explosive component to burst so that said second explosive component therein is released and driven either directly and/or by air pressure into contact with said first component.

2. The warning detonator as claimed in claim 1 wherein each of said cartridges is dimensioned to be a push fit into the cylinder and an end wall of each of said cartridges is concave.

3. The warning detonator as claimed in claim 2 wherein said end wall has lines of weakness formed in a face to facilitate bursting of the face and release of said explosive component.

4. The warning detonator as claimed in claim 3 wherein the second explosive component is located against an inside surface of said concave end wall and is separated from the compressible elastic means by a plug.

5. The warning detonator as claimed in claim 4 wherein the cartridge is moulded from a shatter resistant plastic so that a lateral blow while deforming side walls thereof or collapsing the concave face inwardly, will not rupture said cartridge.

6. The warning detonator as claimed in claim 5 wherein said first explosive component is a smokeless powder in conjunction with potassium chlorate and said second explosive component is red phosphorous.

7. The warning detonator as claimed in claim 6 wherein the side walls of said cartridge extend out past said end wall to maintain a space between said end wall and said first explosive component.

8. The warning detonator as claimed in claim 7 wherein caps are fitted over the ends of the cylinder.

* * * * *